US009432758B1

(12) United States Patent
Kirk

(10) Patent No.: US 9,432,758 B1
(45) Date of Patent: Aug. 30, 2016

(54) ELECTRONIC COASTER

(71) Applicant: Justin Curtis Kirk, Tyler, TX (US)

(72) Inventor: Justin Curtis Kirk, Tyler, TX (US)

( * ) Notice: Subject to any disclaimer, the term of this patent is extended or adjusted under 35 U.S.C. 154(b) by 206 days.

(21) Appl. No.: 14/459,215

(22) Filed: Aug. 13, 2014

Related U.S. Application Data

(60) Provisional application No. 62/026,233, filed on Jul. 18, 2014.

(51) Int. Cl.
*F21V 33/00* (2006.01)
*H04R 1/02* (2006.01)
*H04R 3/00* (2006.01)

(52) U.S. Cl.
CPC ..... *H04R 1/028* (2013.01); *H04R 3/00* (2013.01)

(58) Field of Classification Search
CPC ..... A47G 23/0309
USPC ..... 382/101, 802; 250/221
See application file for complete search history.

(56) References Cited

U.S. PATENT DOCUMENTS 4,344,113 A 8/1982 Ditto et al.
5,732,375 A * 3/1998 Cashler ..... G06K 9/00362 180/273
6,354,711 B1 3/2002 McCoy
6,591,524 B1 * 7/2003 Lewis ..... A47G 19/2227 310/339
2004/0061668 A1 * 4/2004 Lin ..... A63J 17/00 345/39
2007/0291488 A1 * 12/2007 Heathcock ..... H05B 37/0272 362/276
2008/0083475 A1 * 4/2008 Lamb ..... B65B 3/26 141/198

* cited by examiner

*Primary Examiner* — Thanh Luu
(74) *Attorney, Agent, or Firm* — Plager Schack LLP

(57) ABSTRACT

An electronic coaster is configured to respond to pressure and sound. The electronic coaster contains a case that includes a flexible top. The flexible top is configured to deflect upon receiving pressure on the flexible top. A circuit board is attached to the case and configured to receive power from a power source and an audio signal from an audio cable. The circuit board is configured to engage a plurality of photodiodes when pressure is applied to the flexible top and an audio signal is played through the circuit board.

5 Claims, 5 Drawing Sheets

ELECTRONIC COASTER

RELATED APPLICATION

This application claims priority to provisional patent application U.S. Ser. No. 62/026,233 filed on Jul. 18, 2014, the entire contents of which is herein incorporated by reference.

BACKGROUND

The embodiments herein relate generally to drink coasters.

Prior to embodiments of the disclosed invention, drink coasters did not create a light display driven by an audio input source. Embodiments of the disclosed invention solve these problems. The prior art includes U.S. Pat. No. 6,354,711 issued to McCoy, U.S. Pat. No. 6,591,524 issued to Lewis, and U.S. Pat. No. 4,344,113 issued to Ditto.

McCoy teaches a device for illuminating a liquid drink for use at a party or a social event to give the appearance of an illuminated liquid. Lewis teaches an advertising article with an automatically activated indicator assembly attached to the article including a piezoelectric sensor, a printed circuit board including a triggerable signal generator, and an LED or speaker. Ditto teaches a device for illuminating a liquid drink for use at a party or a social event to give the appearance of an illuminated liquid.

However, none of these teach are able to coordinate operating lights in a low ambient light environment with the pressure of a drinking vessel while there is an audio input signal. In particular, none of these use a triple band pass filter to divide the incoming audio signal and coordinate photodiodes such as light emitting diodes.

SUMMARY

An electronic coaster can be configured to respond to pressure and sound. The electronic coaster can contain a case that includes a flexible top. The flexible top can be configured to deflect upon receiving pressure on the flexible top. A circuit board can be attached to the case and configured to receive power from a power source and an audio signal from an audio cable. The circuit board can be configured to engage a plurality of photodiodes when pressure can be applied to the flexible top and an audio signal can be played through the circuit board.

In some embodiments, the circuit board can further comprise a three way bandpass filter electrically coupled to a switching circuit and a power circuit. The switching circuit further comprises pressure circuit that operates a variable resister within switching circuit. The switching circuit can be open when either there can be insufficient pressure on a pressure sensor in the pressure circuit or there can be an either no signal in a range in the three way bandpass filter.

In some embodiments, the three way bandpass filter can further comprise a first band filter, that includes a first band filter resister, which can be varied by first band filter variable resister and electrically coupled to a first band filter resister, a first band filter capacitor, a first band filter capacitor and a first band filter resistor are connected to a first band filter gate. The first band filter gate can be electrically coupled to a first band filter capacitor, a first band filter resister, a first band filter diode, a first band filter capacitor, a first band filter resister and a first band filter switch. When a first band filter condition in first band filter resister can be satisfied then the first band filter gate closes and electrical power flows to first band filter set of photodiodes.

In some embodiments the three way bandpass filter can further comprise a second band filter, further comprising: a second band filter resister, which can be varied by second band filter variable resister and electrically coupled to a second band filter resister, a second band filter capacitor, a second band filter capacitor and a second band filter resistor are connected to a second band filter gate. The second band filter gate can be electrically coupled to a second band filter capacitor, a second band filter resister, a second band filter diode, a second band filter capacitor, a second band filter resister and a second band filter switch, when a second band filter condition in second band filter resister can be satisfied then the second band filter gate closes and electrical power flows to second band filter set of photodiodes.

In some embodiments the three way bandpass filter can further comprise a third band filter, further comprising: a third band filter resister, which can be varied by third band filter variable resister and electrically coupled to a third band filter resister, a third band filter capacitor, a third band filter capacitor and a third band filter resistor are connected to a third band filter gate. The third band filter gate can be electrically coupled to a third band filter capacitor, a third band filter resister, a third band filter diode, a third band filter capacitor, a third band filter resister and a third band filter switch. When a third band filter condition in third band filter resister can be satisfied then the third band filter gate closes and electrical power flows to third band filter set of photodiodes.

In some embodiments, the pressure circuit can further comprise a voltage source, electrically coupled to a first pressure circuit resistor, a second pressure circuit resister, a first pressure circuit capacitor, a pressure circuit gate, which can be further electrically coupled to a pressure sensor. When a pressure sensor circuit condition can be met, the pressure circuit closes and electricity flows through the switching circuit.

In some embodiments, the switching circuit can further comprise a switch. When the pressure circuit condition can be met the switch closes and electricity flows through the switching circuit.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
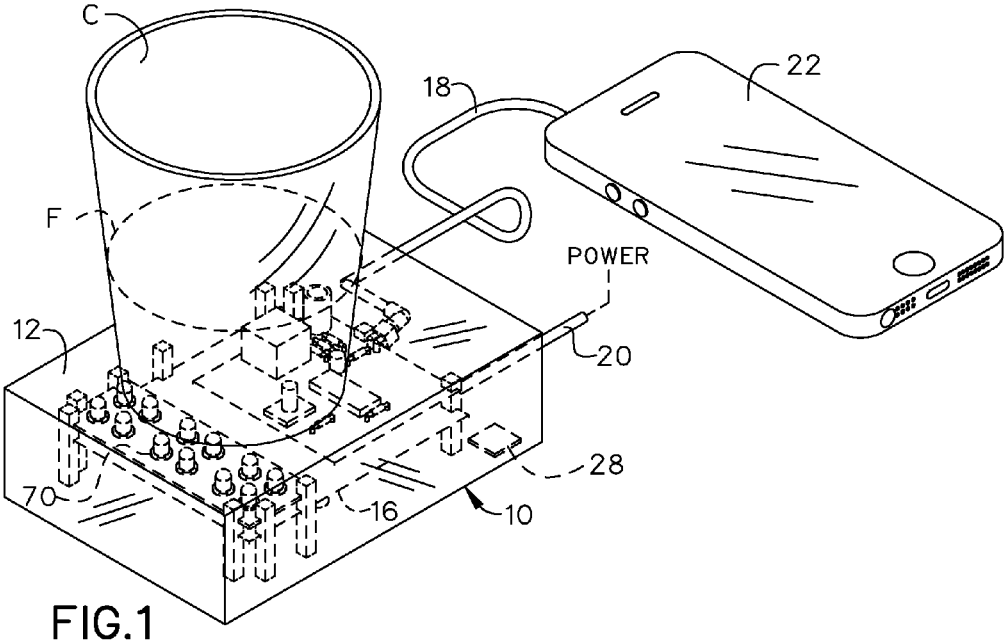
FIG. 1 is a perspective view of an embodiment of the invention shown in use.

By way of example, and referring to FIG. 1, a user desires to have a coaster respond with lights when container C containing fluid F is placed upon electronic coaster 10. Electronic coaster 10 solves this problem as explained in more detail below.

Electronic coaster 10 comprises case 12 mechanically coupled to circuit board 16. Case 12 has a flexible top that is configured to slightly deflect upon some pressure being placed on the flexible top. Circuit board 16 is electrically coupled to external audio device 22 with audio cable 18. Circuit board 16 is further electrically coupled to a power supply with power supply cable 20. In some embodiments, audio cable 18 is a mono cable, in other embodiments it can be a stereo cable. In some embodiments, power supply cable 20 is configured to carry direct current power which can be toggled into circuit board 16 with switch 28.

Figure 10:
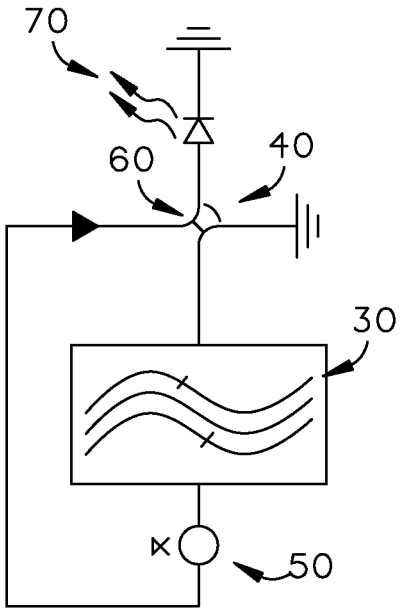
FIG. 10 is an electrical schematic view of an embodiment of the invention.

Circuit board 16 contains a plurality of circuits shown in FIG. 10. Three way bandpass filter 30 is electrically coupled to switching circuit 40 and power circuit 50. Switching circuit 40 further comprises pressure circuit 60 which operates a variable resister within switching circuit 40. When pressure is placed upon the flexible top pressure engages a pressure sensor on pressure circuit 60. When switching circuit 40 is closed and when a signal travels through bandpass filter 30, electrical power travels through photodiode 70 causing visible light to be emitted. Each circuit has a slightly differently configured three way bandpass filter 30 in order to engage a different photodiode 70 when a different sound is played from external audio device 22.

Figure 2:
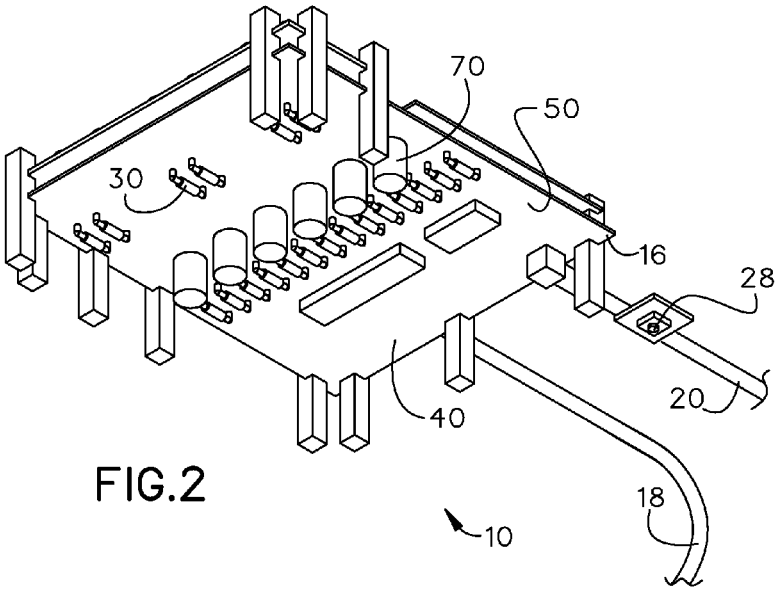
FIG. 2 is a bottom detail perspective view of the invention.
Figure 3:
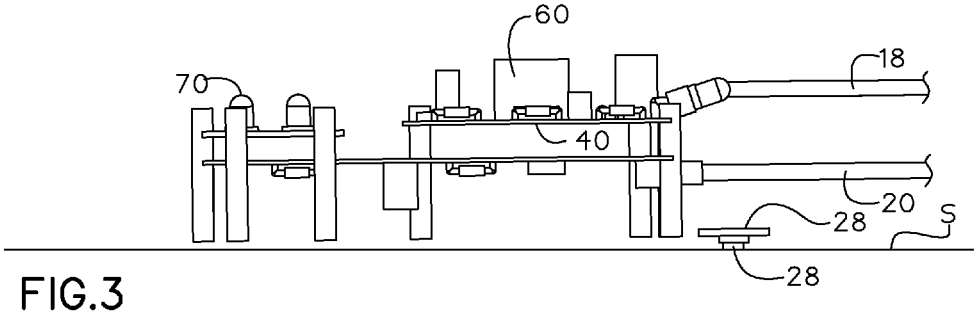
FIG. 3 is a side detail view of an embodiment of the invention shown without item on top.
Figure 4:
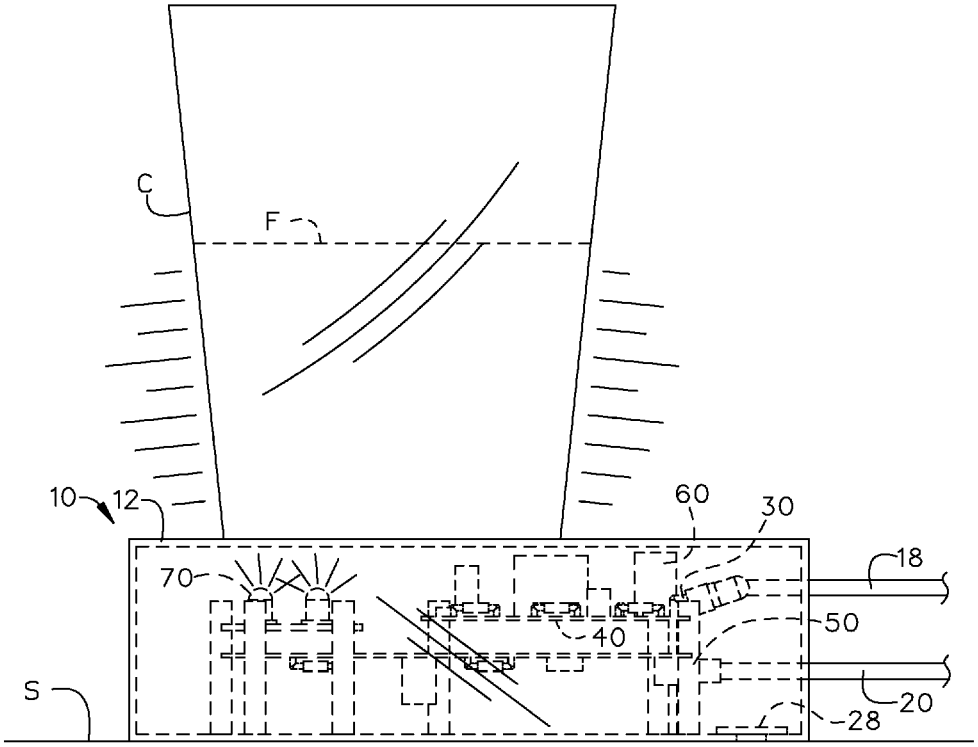
FIG. 4 is a side detail view of an embodiment of the invention shown with item on top and in activated state.

FIG. 2, FIG. 3 and FIG. 4, show some more details as to how a plurality of circuits operate together. Three way bandpass filters 30 are electrically coupled to audio jack 32. In some embodiments, a second audio cable 34 enables a user to connect a plurality of three way bandpass filters 30, perhaps through additional coasters 10. That plurality of three way bandpass filters 30 allows a single range of signals to pass through a single filters. When aggregated, numerous signals, pass through numerous filters to enable the coaster to light up in different light patterns. However, photodiodes 70 will not light up unless there is adequate pressure on pressure circuit 40. Both audio signals and pressure are necessary for operation in one mode of operation.

Figure 5:
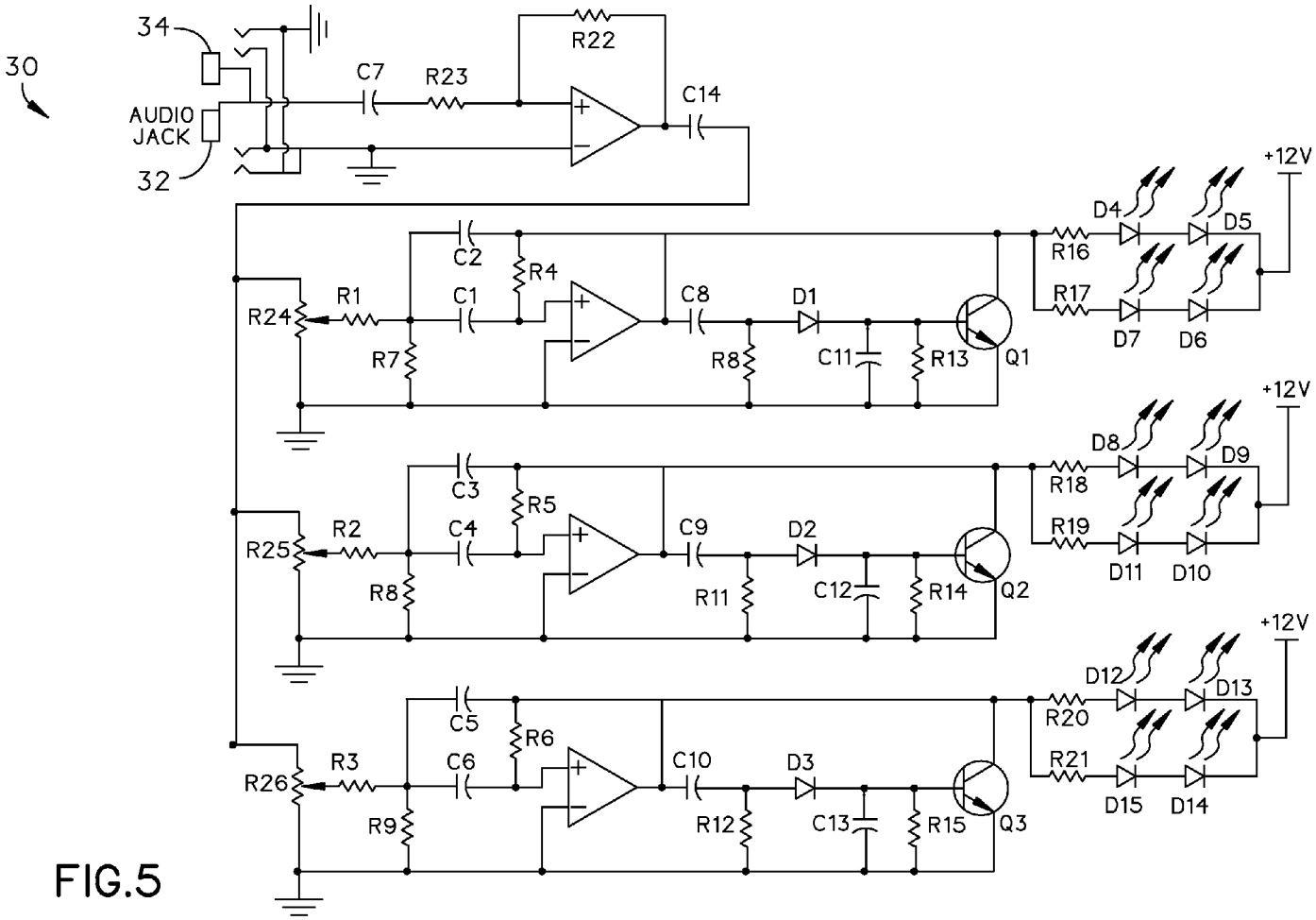
FIG. 5 is an electrical schematic view of an embodiment of the invention.

FIG. 5 shows three way bandpass filter 30 in more detail. Three way bandpass filter 30 comprises an audio jack electrically coupled to a first gate with capacitor C7 and resister R23. The gate is in parallel with resister R22. The first gate is electrically coupled to a first band filter, a second band filter and a third band filter with capacitor C14.

The first band filter comprises first band filter resister R24, which is varied by first band filter variable resister R1 and electrically coupled to first band filter resister R7, first band filter capacitor C1, first band filter capacitor C2 and first band filter resistor R4 are connected to a first band filter gate. The first band filter gate is electrically coupled to first band filter capacitor C8, first band filter resister R8, first band filter diode D1, first band filter capacitor C11, first band filter resister R13 and first band filter switch Q1, when the condition in first band filter resister R1 is satisfied then the first band filter gate closes and electrical power flows to first band filter set of photodiodes D4, D5, D6 and D7.

The second band filter comprises second band filter resister R25, which is varied by second band filter variable resister R2 and electrically coupled to second band filter resister R8, second band filter capacitor C3, second band filter capacitor C4 and second band filter resistor R5 are connected to a second band filter gate. The second band filter gate is electrically coupled to second band filter capacitor C9, second band filter resister R11, second band filter diode D2, second band filter capacitor C12, second band filter resister R14 and second band filter switch Q2, when the condition in second band filter resister R2 is satisfied then the second band filter gate closes and electrical power flows to second band filter set of photodiodes D8, D9, D10 and D11.

The third band filter comprises third band filter resister R26, which is varied by third band filter variable resister R3 and electrically coupled to third band filter resister R9, third band filter capacitor C5, third band filter capacitor C6 and third band filter resistor R6 are connected to a third band filter gate. The third band filter gate is electrically coupled to third band filter capacitor C10, third band filter resister R12, third band filter diode D3, third band filter capacitor C13, third band filter resister R15 and third band filter switch Q3, when the condition in third band filter resister R3 is satisfied then the third band filter gate closes and electrical power flows to third band filter set of photodiodes D12, D13, D14 and D15.

Figure 6:
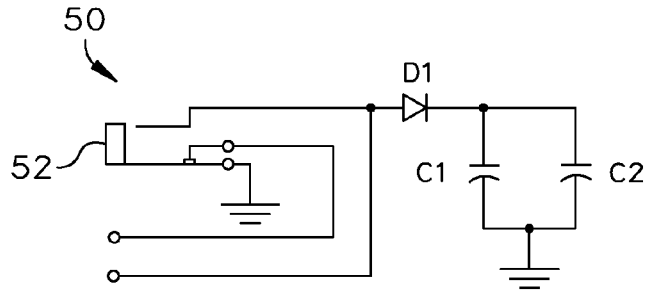
FIG. 6 is an electrical schematic view of an embodiment of the invention.

FIG. 6 shows the power supply circuit 50 in more detail. Direct current power flows from a power source, such as a battery to circuit board 16. Power is filtered for overcharges by running errant power through power diode D1 through two capacitors in parallel C1, C2 and then to ground.

Figure 7:
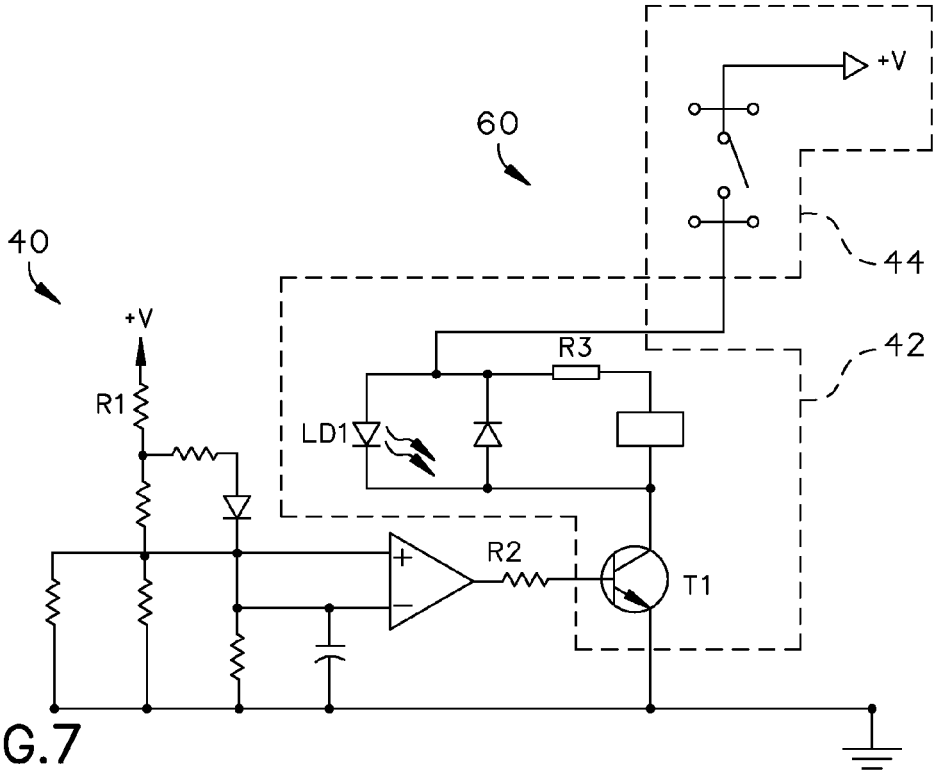
FIG. 7 is an electrical schematic view of an embodiment of the invention.

FIG. 7 shows switching circuit 40 in more detail. There are two switches in switching circuit 40: pressure switch 42 and light sensor 44. Pressure switch 42 is open when there is no pressure on pressure circuit 60 and closed when there is pressure on pressure circuit 60. Light sensor 44 comprises light dependent resistor LD1 connected to resister R3, a diode and another resister. When light is shown on light dependent resistor LD1, resistance becomes infinite and the circuit opens. Alternately, when light is not shown on light dependent resistor LD1, resistance becomes finite and the circuit closes. Substituting, components can result in the circuit closing when light is present. This is a matter of user preference. Switching circuit 40 is connected to pressure circuit 60 shown below. When the condition of pressure circuit 60 is reached transistor T1 closes and power flows from +V to +12 VDC. When the switching circuit gate is open, the electrical power flows to ground.

Figure 8:
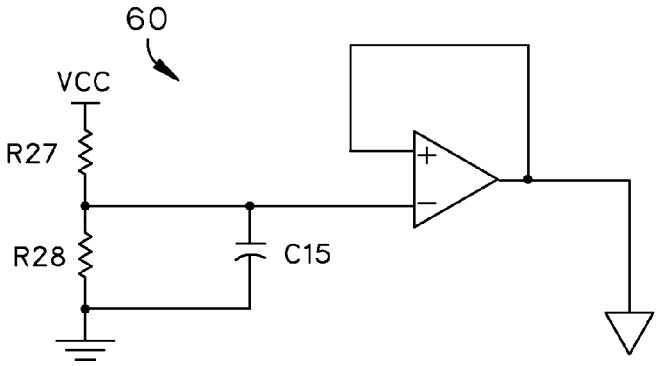
FIG. 8 is an electrical schematic view of an embodiment of the invention.

FIG. 8 shows pressure circuit 60 in more detail. A voltage source is electrically coupled to a first pressure circuit resistor R27, a second pressure circuit resister R28, a first pressure circuit capacitor C15. These are electrically coupled to a pressure circuit gate, which is further electrically coupled to pressure sensor 42. When a pressure sensor circuit condition is met the circuit closes and electricity can flow through switching circuit 40.

Figure 9:
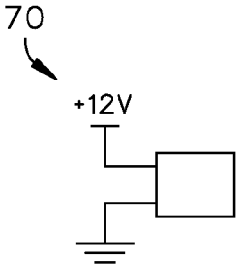
FIG. 9 is an electrical schematic view of an embodiment of the invention.

FIG. 9 shows how photodiode 70 operates when switching circuit 40 closes and when a band in three way band pass filter closes. When both conditions are met, electrical power flows through photodiode 70 to ground lighting up photodiode 70.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. An electronic coaster, configured to respond to pressure and sound; the electronic coaster comprising:

a case, further comprising a flexible top; wherein the flexible top is configured to deflect upon receiving pressure on the flexible top; and a circuit board attached to the case and configured to receive power from a power source and an audio signal from an audio cable;

wherein the circuit board is configured to engage a plurality of light emitting elements when pressure is applied to the flexible top and an audio signal is played through the circuit board;

wherein the circuit board further comprises: a three way bandpass filter electrically coupled to a switching circuit and a power circuit; wherein the switching circuit further comprises pressure circuit that operates a variable resister within switching circuit; wherein the switching circuit is open when either there is insufficient pressure on a pressure sensor in the pressure circuit or there is an either no signal in a range in the three way bandpass filter.

2. The electronic coaster of claim 1, further comprising a light dependent resistor connected to the circuit board and configured to close the circuit when no light is present and open the circuit when light is present.

3. The electronic coaster of claim 1, wherein the three way bandpass filter further comprises:

a first band filter, further comprising: a first band filter resister, which is varied by first band filter variable resister and electrically coupled to a first band filter resister, a first band filter capacitor, a first band filter capacitor and a first band filter resistor are connected to a first band filter gate; wherein the first band filter gate is electrically coupled to a first band filter capacitor, a first band filter resister, a first band filter diode, a first band filter capacitor, a first band filter resister and a first band filter switch, when a first band filter condition in first band filter resister is satisfied then the first band filter gate closes and electrical power flows to first band filter set of light emitting elements;

a second band filter, further comprising: a second band filter resister, which is varied by second band filter variable resister and electrically coupled to a second band filter resister, a second band filter capacitor, a second band filter capacitor and a second band filter resistor are connected to a second band filter gate; wherein the second band filter gate is electrically coupled to a second band filter capacitor, a second band filter resister, a second band filter diode, a second band filter capacitor, a second band filter resister and a second band filter switch, when a second band filter condition in second band filter resister is satisfied then the second band filter gate closes and electrical power flows to second band filter set of light emitting elements; and a third band filter, further comprising: a third band filter resister, which is varied by third band filter variable resister and electrically coupled to a third band filter resister, a third band filter capacitor, a third band filter capacitor and a third band filter resistor are connected to a third band filter gate; wherein the third band filter gate is electrically coupled to a third band filter capacitor, a third band filter resister, a third band filter diode, a third band filter capacitor, a third band filter resister and a third band filter switch, when a third band filter condition in third band filter resister is satisfied then the third band filter gate closes and electrical power flows to third band filter set of light emitting elements.

4. The electronic coaster of claim 1, wherein the pressure circuit further comprises: a voltage source, electrically coupled to a first pressure circuit resistor, a second pressure circuit resister, a first pressure circuit capacitor, a pressure circuit gate, which is further electrically coupled to a pressure sensor; wherein a pressure sensor circuit condition is met the pressure circuit closes and electricity flows through the switching circuit.

5. The electronic coaster of claim 4, wherein the switching circuit further comprises a switch such that when the pressure circuit condition is met the switch closes and electricity flows through the switching circuit.

* * * * *